US005525107A

United States Patent [19]

Shao

[11] Patent Number: 5,525,107

[45] Date of Patent: Jun. 11, 1996

[54] INDOOR HANGING WINDOW FAN

[75] Inventor: Steve Shao, Framingham, Mass.

[73] Assignee: Accutek Products Corp., Northboro, Mass.

[21] Appl. No.: 309,950

[22] Filed: Sep. 21, 1994

[51] Int. Cl.[6] ..... E06B 7/03

[52] U.S. Cl. ..... 454/204; 454/200

[58] Field of Search ..... 454/200, 201, 454/204, 207

[56] References Cited

U.S. PATENT DOCUMENTS

| | | | |
|---|---|---|---|
| 1,680,909 | 8/1928 | Parent . | |
| 1,954,017 | 4/1934 | Manning . | |
| 2,010,809 | 8/1935 | Braine . | |
| 2,035,653 | 3/1936 | Haskell | 454/204 X |
| 2,081,105 | 5/1937 | Reynolds et al. . | |
| 2,296,635 | 9/1942 | Foehrenbach et al. | 454/207 X |
| 2,373,497 | 4/1945 | Paiste . | |
| 2,467,297 | 4/1949 | Doe | 454/200 |
| 2,528,301 | 10/1950 | Doe | 454/207 |
| 2,720,826 | 10/1955 | Brookins | 454/204 |
| 3,118,364 | 1/1964 | Sinclair | 454/200 |
| 3,275,224 | 9/1966 | Bush . | |
| 3,315,587 | 4/1967 | Horan . | |
| 3,680,974 | 8/1972 | Smith . | |
| 4,002,109 | 1/1977 | Hori et al. . | |
| 4,899,645 | 2/1990 | Wolfe et al. | 454/200 X |
| 5,197,299 | 3/1993 | Sohn et al. . | |

FOREIGN PATENT DOCUMENTS 2-306037 12/1990 Japan .

OTHER PUBLICATIONS

Carrier Room Air Conditioners, *Information Guide*, V851-176; Dec. 1993.

L-Shaped Air Conditioner–pp. 4 and 5.

Homes Air advertisment 'PSST, Mr. Buyer, We're Your #1 Fan; HomeWorld Newspaper vol. 5, No. 17, Aug. 16-29, 1993.

*Primary Examiner*–Harold Joyce
*Attorney, Agent, or Firm*–Francis E. Marino

[57] ABSTRACT

An electrical window fan comprising a reversible motor driven air blower assembly and a housing having intake and exhaust openings and a rectangular duct with an internal minor width smaller than the major diameter of the blower, the duct being adapted to extend through a window opening and for hanging the fan over the stool cap of the window such that most of the fan is positioned indoor of and below the window opening.

3 Claims, 8 Drawing Sheets

INDOOR HANGING WINDOW FAN

BACKGROUND OF THE INVENTION

This invention relates to fans, particularly to window fans which are positioned at a window to ventilate a building by intaking or exhausting air between the outside and inside of the building.

Window fans have been in use for many years. They offer many advantages over indoor fans. In addition to the cooling effect realized when any fan causes air movement over the human skin, window fans provide the additional benefit of exchanging inside air with outside air. When exhausting air from a building, they can draw stale, hot or smoky indoor air out. When intaking, they can draw more comfortable fresh air in. By placing a window fan within the window opening, valuable indoor floor space can be saved.

By far the most common window fans are those designed for use with double-hung windows. These are windows with parallel upper and lower sashes which slide vertically within parallel side tracks of the window frame to open and close. The sashes are comprised of glass panels within wooden frames. The sash frames include two parallel vertical side members which engage the side tracks of the window frame, and upper and lower horizontal members. The upper sash is positioned within the outdoormost track, the lower sash within the indoormost track. The vertical indoor side of the upper sash is coplanar with the vertical outdoor side of the lower sash and overlaps the lower sash vertically at the bottom of the top sash and top of the bottom sash. These windows are opened in either of two ways, the top sash can be slid downward to create an opening at the top of the window or the bottom sash can be raised to create an opening at the bottom of the window. Since top opening is more difficult and less convenient, and since curtains and shades are often positioned at the top of the window, double-hung windows are most often opened at the bottom.

Window fans for double-hung windows are generally designed to fit within the window's bottom opening. Until recently, it was common to design the fans to be attached to the sashes' tracks or to the vertical wooden mouldings commonly adorning the indoor side of the frame of the window. Recently, there has been a trend in designing window fans to fit into the window without the use of hardware. These recent fans include many embodiments. Some simply sit within the opening and rely on downward force from the weight of the lower sash to hold the fan in place under the vibrations of normal use. Some, such as that described in U.S. Pat. No. 4,838,151, exert outward pressure to the sash tracks, thereby allowing the lower sash to be further raised while the fan remains independently in place. Some have upwardly projecting tabs on the fan housing which project up on the inside and the outside of the lower horizontal sash frame member to position the fan. In some cases, such as that described in U.S. Pat. No. 5,110,263, those tabs are biased together in order to grasp onto the lower horizontal sash frame member.

Double hung windows include an element known as the "stool cap" forming the lower limit of the bottom opening. The stool cap forms a shelf along the horizontal bottom portion or "stool" of the window frame. The stool is the lower horizontal member of the window frame and slopes downwardly from the indoor side to the outdoor side of the window. The stool cap is permanently affixed atop the peaked indoor edge of the stool and generally can range in depth, measured indoor-to-outdoor, from two inches to four and one half inches. The top of the stool cap is a horizontal surface both across the window and from indoors to outdoors. The vertical outdoor side of the stool cap is coplanar with the vertical indoor side of the lower sash and overlaps the lower sash vertically by about one half inch when the lower sash is fully closed, to thereby form a weather seal. The indoor side of the stool cap extends into the interior of the home or building generally about one inch to three inches and is generally one half to three quarters of an inch high.

In U.S. Pat. No. 4,222,318 a fan is described which includes a floor stand which also serves as a window engaging device for window fan use. The stand rests against the indoor edge of the stool cap and leans indoorwardly against the outdoor surface of the horizontal lower sash frame member. The center of gravity of the fan assembly is substantially indoors in order to maintain a leaning force against the lower sash frame member that thereby maintains the fans position just indoor of the window opening. If the lower sash is raised however, the fan will fall indoors.

All of the fans so far described require that the window be opened substantially. All include an axial blower and require that the window opening be larger than the blower's major diameter in order to avoid turbulence and maximize air flow and efficiency. All of these fans are positioned where the view through the lower portion of the window is substantially disturbed. There has been a recent trend to design fans, and other fan products such as air conditioners, which minimize the disturbance of one's view through the window. These products have been categorized generically as "low profile" fans and air conditioners. In these low profile devices, window opening is reduced over conventional designs.

One method which has been employed in a window fan to reduce the window opening uses a motorized cylindrical blower assembly having a horizontally oriented axis which lies within and across the window opening. The axis extends from adjacent one of the vertical window side frames to adjacent the other. This blower assembly has a cross sectional profile similar in aspect to the window opening. The window opening height therefor is not much larger than the blower major diameter. In such a fan it is practical to employ a blade, for instance, four inches in major diameter and fifteen inches long measured axially, and to rotate the blade fast enough to produce sufficient airflow at acceptable noise level. Such a blower, when enclosed in a housing with sufficient clearances around the blower, can be designed to require a window opening of six to eight inches. To obtain similar airflow and noise performance from an axial blower would require that the blower have a major diameter of approximately twelve inches and therefore require a window opening height of fourteen to sixteen inches. The reduction of approximately eight inches in window fan opening height can be readily appreciated as a significant improvement however, six to eight inches may still be considered an unacceptable view disturbance.

This basic concept is also employed in some existing low profile air conditioners which further include air cooling means. Although the cylindrical blower may be positioned within the window opening, such air cooling means which are more bulky than the cylindrical blower and which create high noise and condensation must be positioned outdoors of the window where the heat by-produced from the cooling process can be dissipated to the environment. This results in two potential safety drawbacks. Those electrical component required by the cooling means are located also outdoors and subject to wetting and corrosion by weather. And, although the means used to secure an air conditioner to the window are substantially designed for strength and permanence, should such fail, the heavy air conditioner would be inclined to fall to the outdoors with obvious potential safety consequences.

Another method which has been employed in a window fan to reduce the window opening uses a motorized cylindrical blower assembly having a vertically oriented axis which lies within the window opening. The axis extends from adjacent the stool cap to adjacent the lower horizontal sash frame member. The window opening height here too is not much larger than the blower height. In such a fan it is practical to employ a blade, for instance, eight inches in major diameter and four inches tall measured axially, and to rotate the blade fast enough to produce sufficient airflow at acceptable noise level. Such a blower, when enclosed in a housing with sufficient clearances around the blower, can also be designed to require a window opening of six to eight inches. As before, six to eight inches may still be considered an unacceptable view disturbance.

It is further another method employed in a window fan to use a horizontally oriented cylindrical blower assembly which is positioned outdoors. Such a design further reduces the required window opening height by employing a rectangular air flow duct in communication with the blower and extending through the window opening. The duct has a height smaller than the blower major diameter. The window opening height need only by slightly taller than the duct height. Should such a fan use a blower assembly of similar dimensions to that horizontal blower assembly already described, a duct height and therefor a window opening height of only approximately two inches would be allowable to maintain acceptable airflow and noise performance. This minimal window opening is an extreme improvement over conventional axial blower window fans, yet shares the same two safety concerns as the above described air conditioner as a result of the electrical components and center of gravity being positioned outdoors.

It is the object of the present invention to provide an improved low profile window fan which is positioned indoors for safety and convenience while minimizing window opening height for improved view.

SUMMARY OF THE INVENTION

The present invention is a low profile window fan which is positioned at a double-hung window indoor of the window opening. Because the fan hangs from the window stool and does therefor not require contact with a window sash, it is also useable in a horizontal casement window wherein the sash is hingedly attached at the top of the window frame and swings outdoorwardly to expose the stool cap. The invention can also be used at a sliding type window wherein the sashes slide horizontally to create a vertically oriented opening adjacent the window side frames by positioning the fan in a vertical orientation, ninety angular degrees from the double-hung position.

The main body of the fan, that being the housing which encloses a motorized cylindrical blower assembly, is located such that it hangs from the stool predominantly below the window opening. A rectangular air duct, having a height equivalent to the intended window opening height, extends from the fan housing towards or through the window opening. The duct includes a mechanism by which the fan can be hung over and securely from the stool cap. The weight of the fan, having a center of gravity approximately located at the axis of the horizontally oriented blower assembly, acts to pull the fan down onto the stool cap, actually increasing the security of the fan's engagement with the window.

The motorized blower assembly is capable of reversing air flow direction, although described herein as including an electrically reversible motor to accomplish this function, moveable air baffles which redirect the air flow are well known and could also be employed to accomplish this function mechanically. As a result, the fan's intake and exhaust openings exchange function such that either desirable outdoor air can be drawn through the window opening, through the duct, through the blower, and into the indoors, or undesirable indoor air can be drawn into the blower, through the duct, and through the window opening to the outdoors.

As window sizes and specifications vary within standard limits, the fan is equipped with adjustment engagement features to allow for use with most windows. Although it is primarily intended that the fan can be securely hung at the window without additional securing hardware, the invention also anticipates the need to employ such hardware in extraordinary cases where unique or custom windows exceed normal specification limits.

DESCRIPTION OF THE PREFERRED EMBODIMENT

Figure 1:
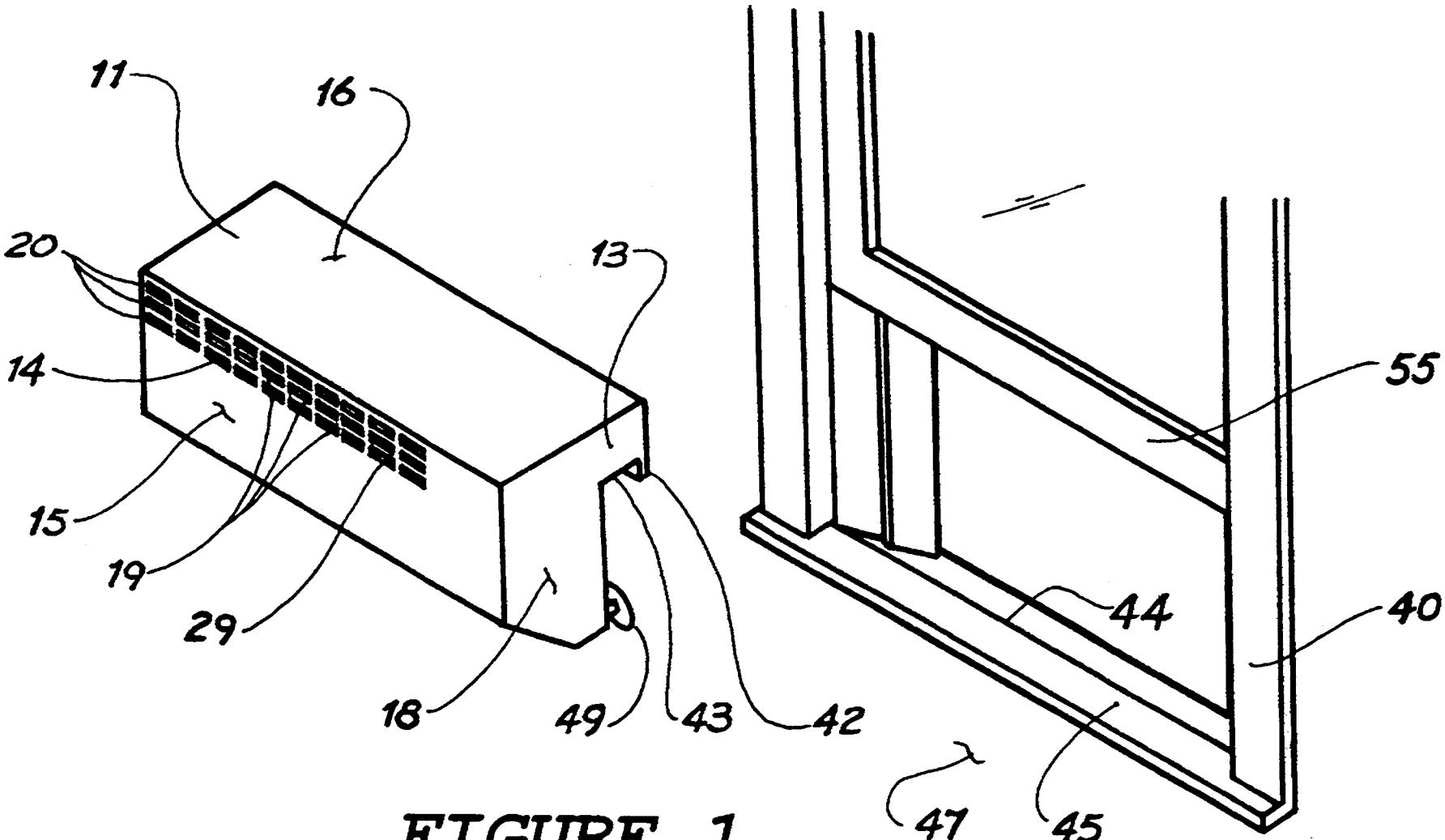
FIG. 1 is a perspective view of the preferred embodiment of the invention adjacent a typical double-hung window.
Figure 2:
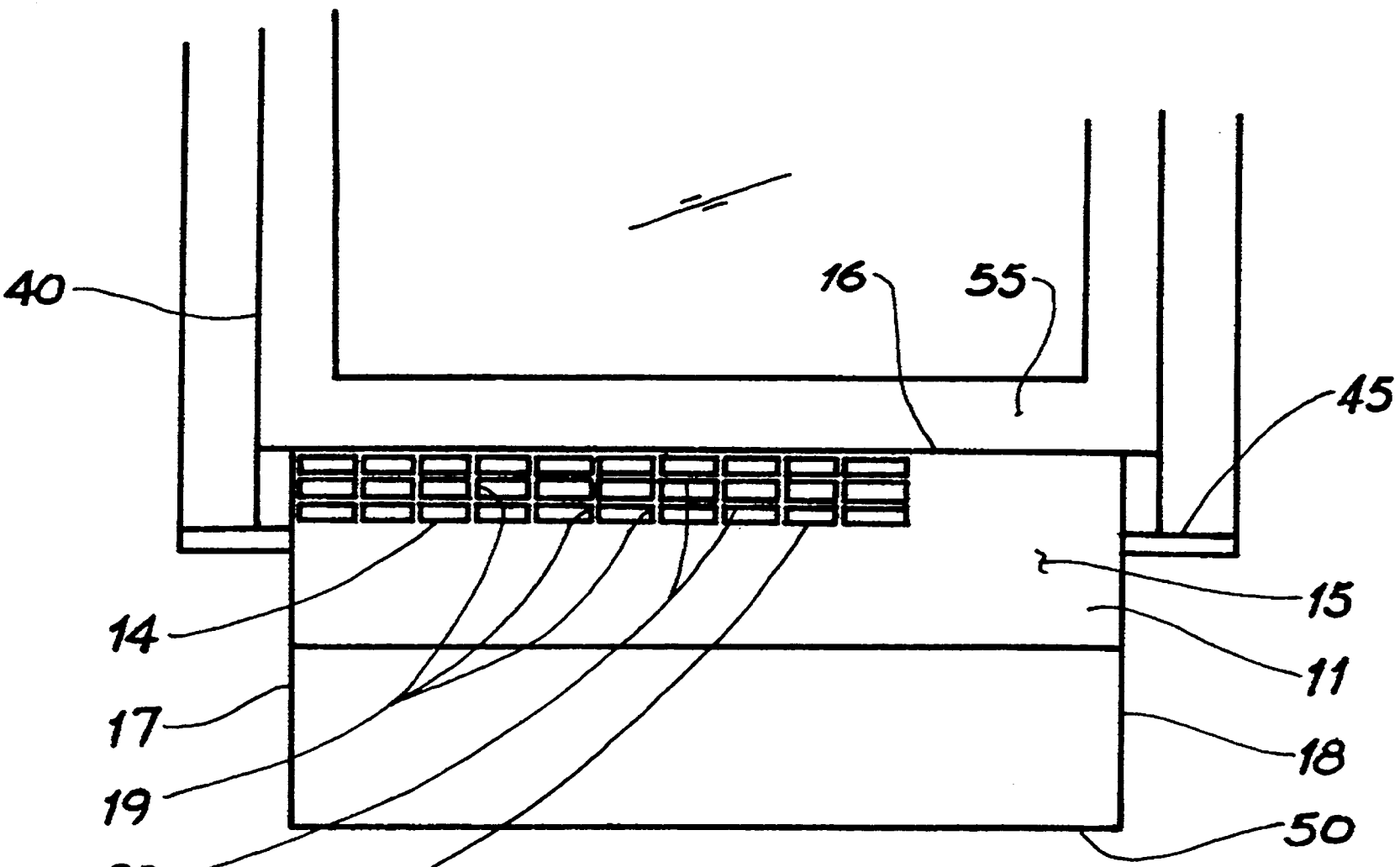
FIG. 2 is an indoor view of the fan of FIG. 1 hung at the window of FIG. 1.
Figure 3:
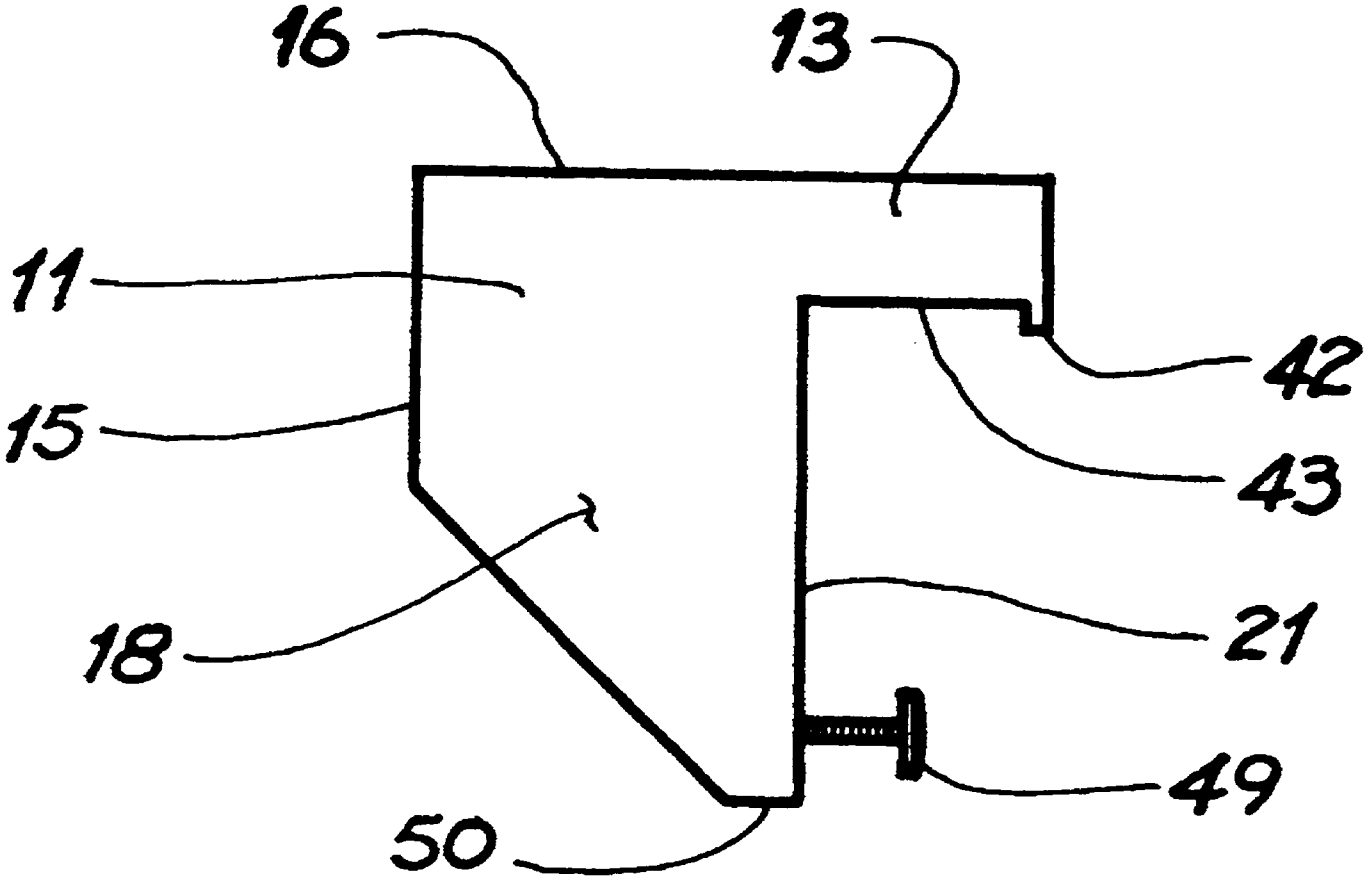
FIG. 3 is a an end view of the fan of FIG. 1.
Figure 4:
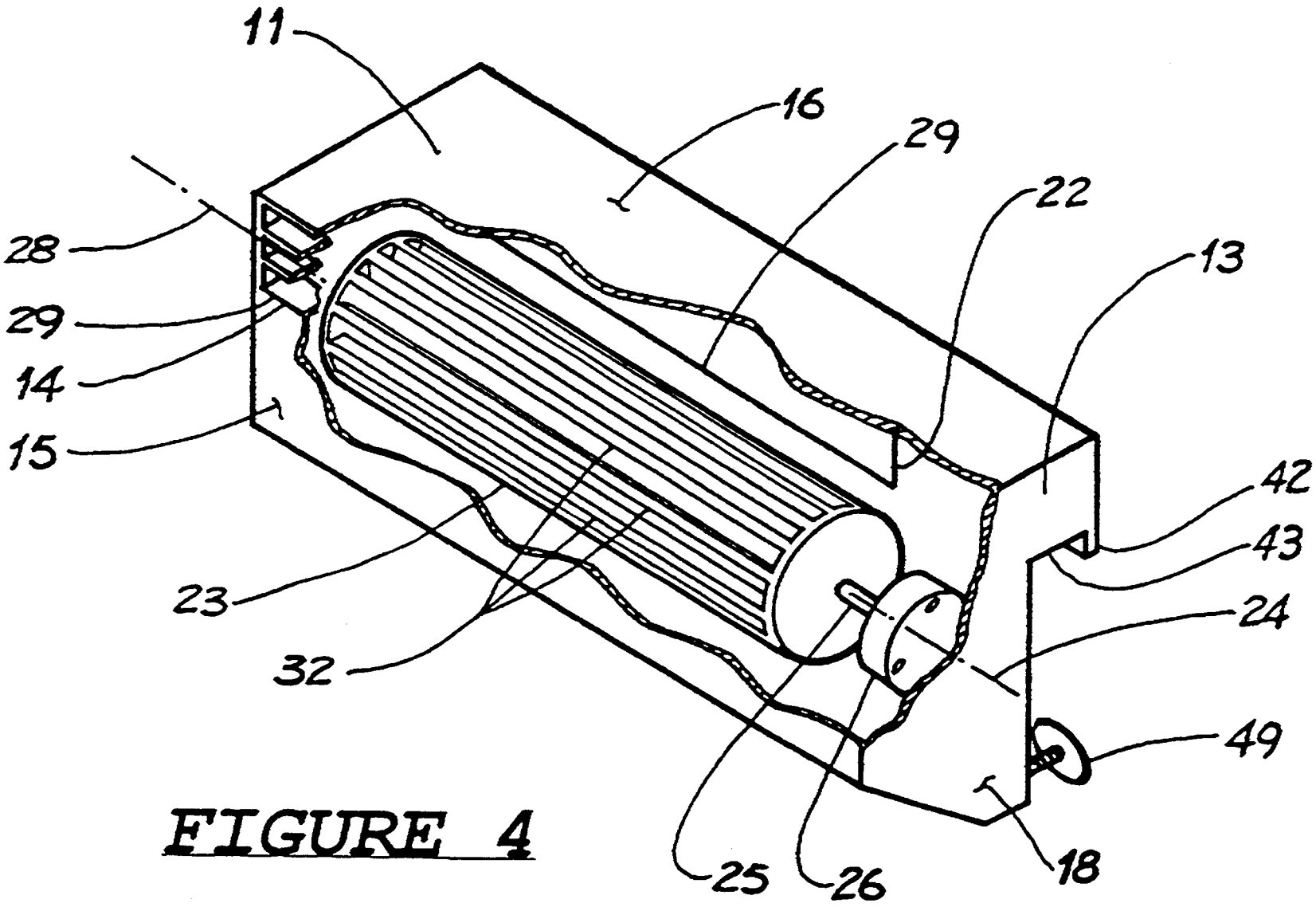
FIG. 4 is a cut away perspective view of the fan of FIG. 1 exposing the motor and cylindrical blower.

A fan of the preferred embodiment is depicted in FIGS. 1 through 8. It includes an injection molded plastic fan housing (11), approximately twenty two inches long horizontally, which encloses a motorized cylindrical blower assembly (12). The fan housing includes an integrally molded rectangular external duct (13) approximately two inches high. The overall height of the fan housing is approximately ten inches and the depth indoor-to-outdoor is approximately six inches. A first air opening (14) approximately fifteen inches long and two inches high is located through the indoor surface (15) of the fan housing adjacent the top surface (16). The opening is positioned vertically adjacent the first end wall (17) of the fan housing opposite the motor-end second end wall (18). During exhaust use of the fan, this first opening serves as the intake opening of the fan. A series of vertical (19) and horizontal (20) rib members cross this first air opening to prevent insertion of objects such as human fingers, for safety purposes. The outdoor surface (21) of the fan housing includes a second air opening (22) similar in size, shape, and position to the first opening, and aligned indoor-to-outdoor therewith. The second opening does not require those safety ribs as does the first opening. During exhaust use of the fan, this second opening serves as the exhaust opening of the fan. Extending from the outdoor surface of the fan housing is the aforementioned external duct which surrounds the second opening but runs the entire length of the fan housing. As the fan housing, including the external duct, is a relatively thin walled structure, the interior height of the external duct is also approximately two inches.

The blower assembly has a major diameter "D" of approximately four inches. It includes a cylindrical blower (23) which has a length along the horizontally oriented axis (24) of approximately fifteen inches and is aligned horizontal with the first and second openings. The blower is attached to the motor shaft (25) and concentric thereto. The motor (26) is fixedly secured to the fan housing by conventional hardware (27) such that the axis of the motor shaft (28), and thereby of the blower, lies approximately one half inch below the bottom edges (29) of the first and second openings. The uppermost tip (30) of the blower diameter thereby lies approximately one and one half inches above those bottom edges and one half inch below the top surface (31) of the fan housing. The blower is positioned indoor-to-outdoor centrally within the six inch depth of the fan housing.

Figure 5:
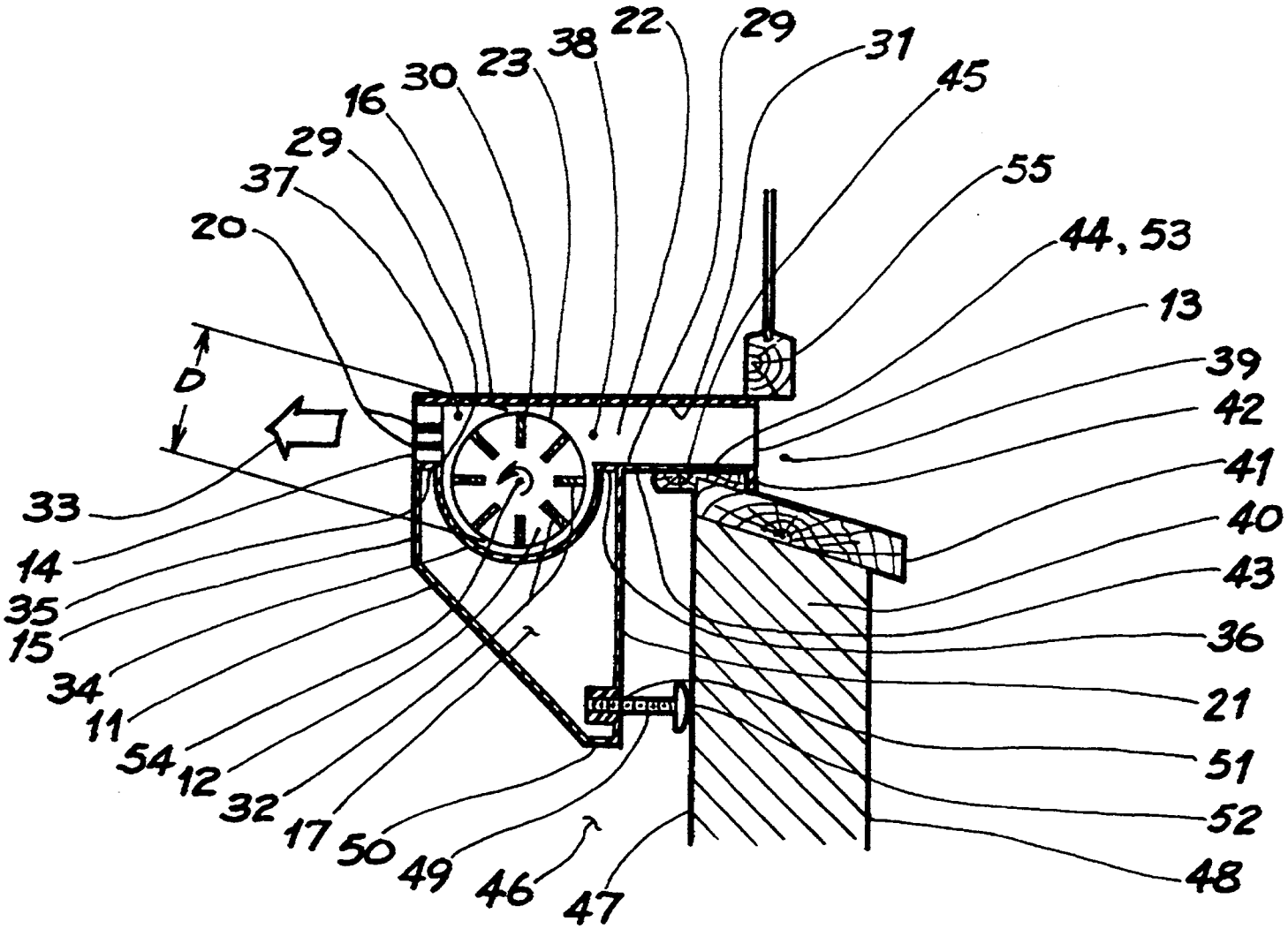
FIG. 5 is a cross-sectional motor-end view of the fan of FIG. 1 hung at the window of FIG. 1 taken through the cylindrical blower and one of the feet, in the intake mode.
Figure 6:
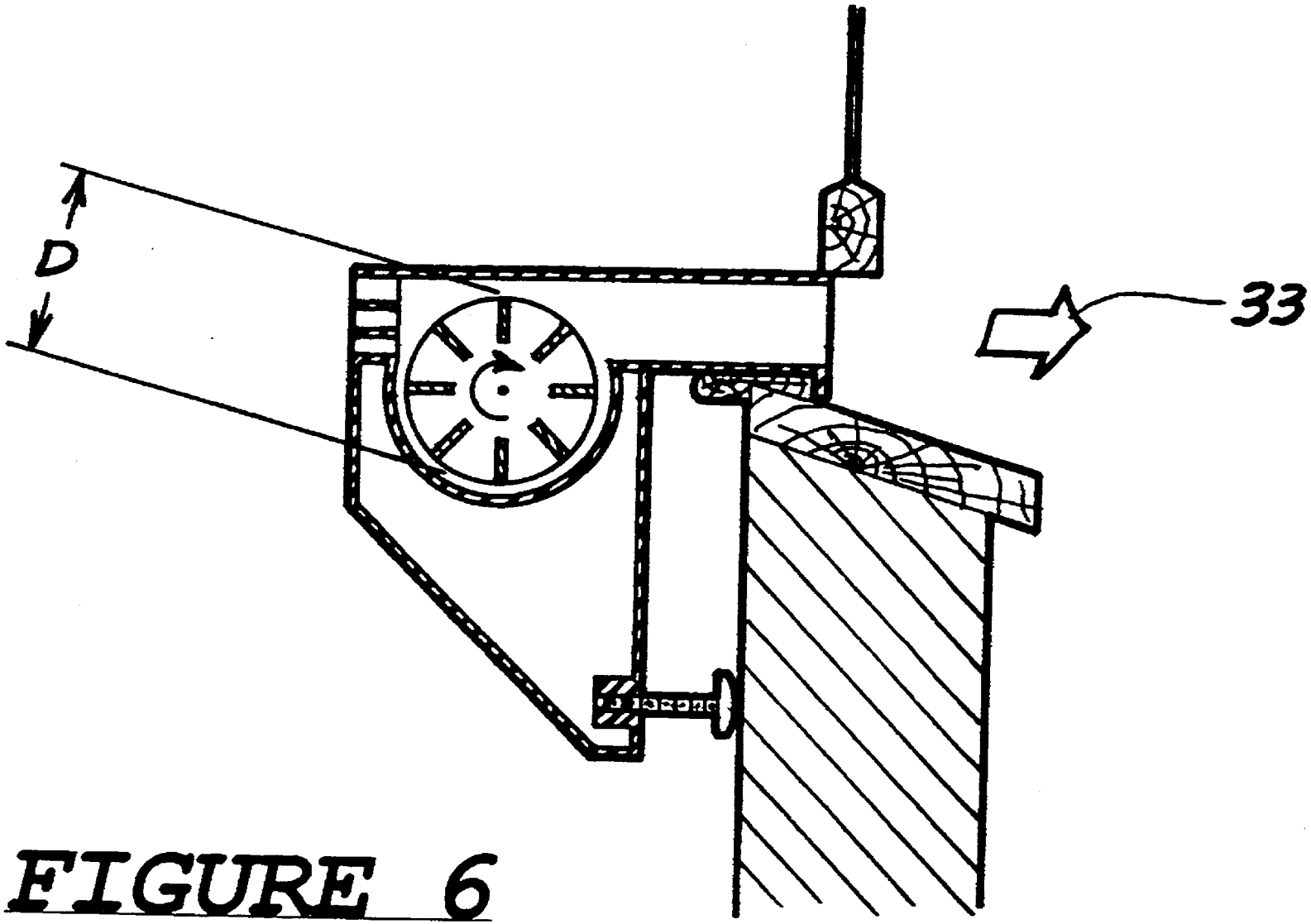
FIG. 6 is the view of FIG. 5, but in the exhaust mode.
Figure 7:
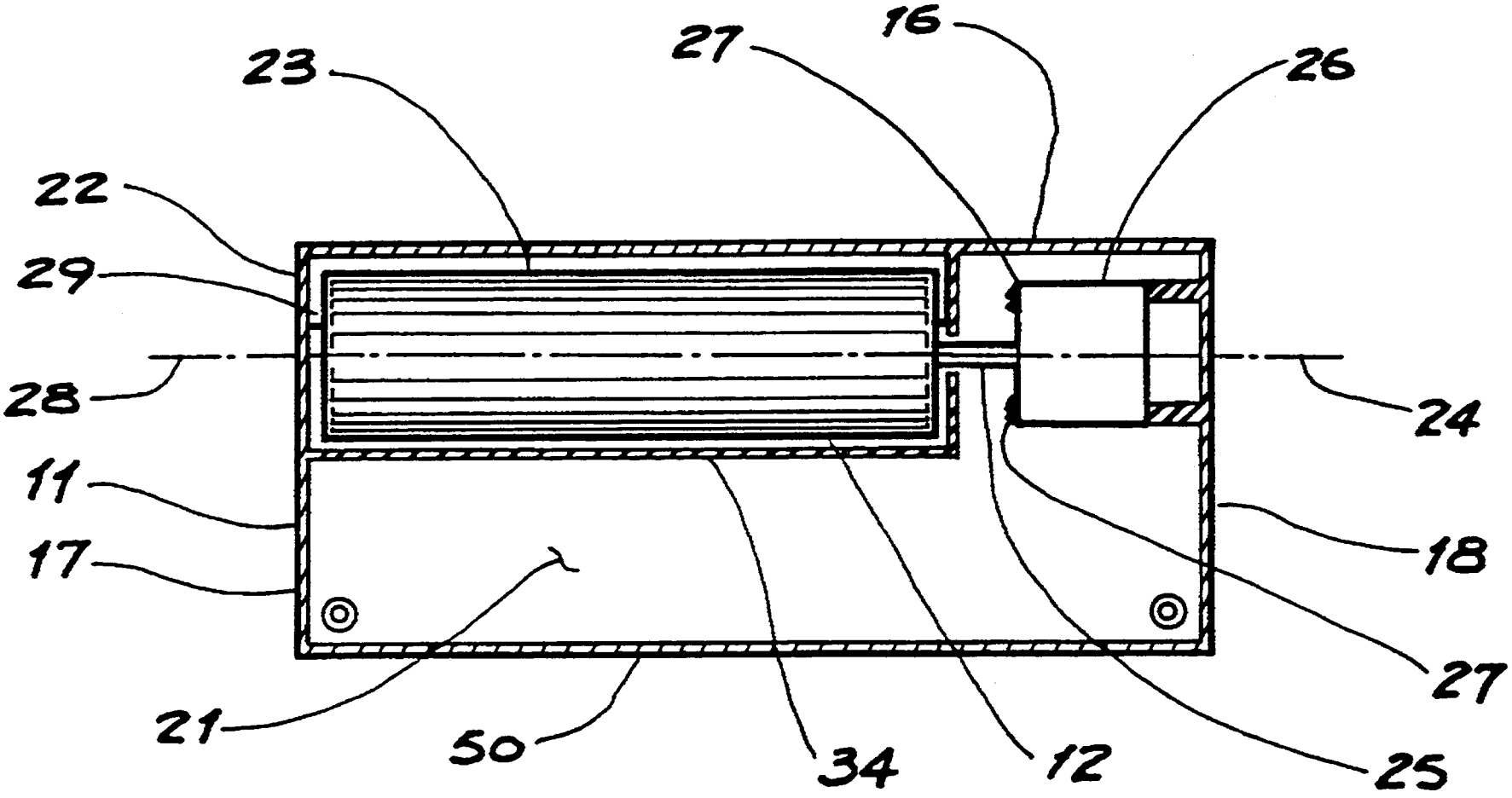
FIG. 7 is a cross-sectional indoor view of the fan of FIG. 1 exposing the blower assembly.
Figure 8:
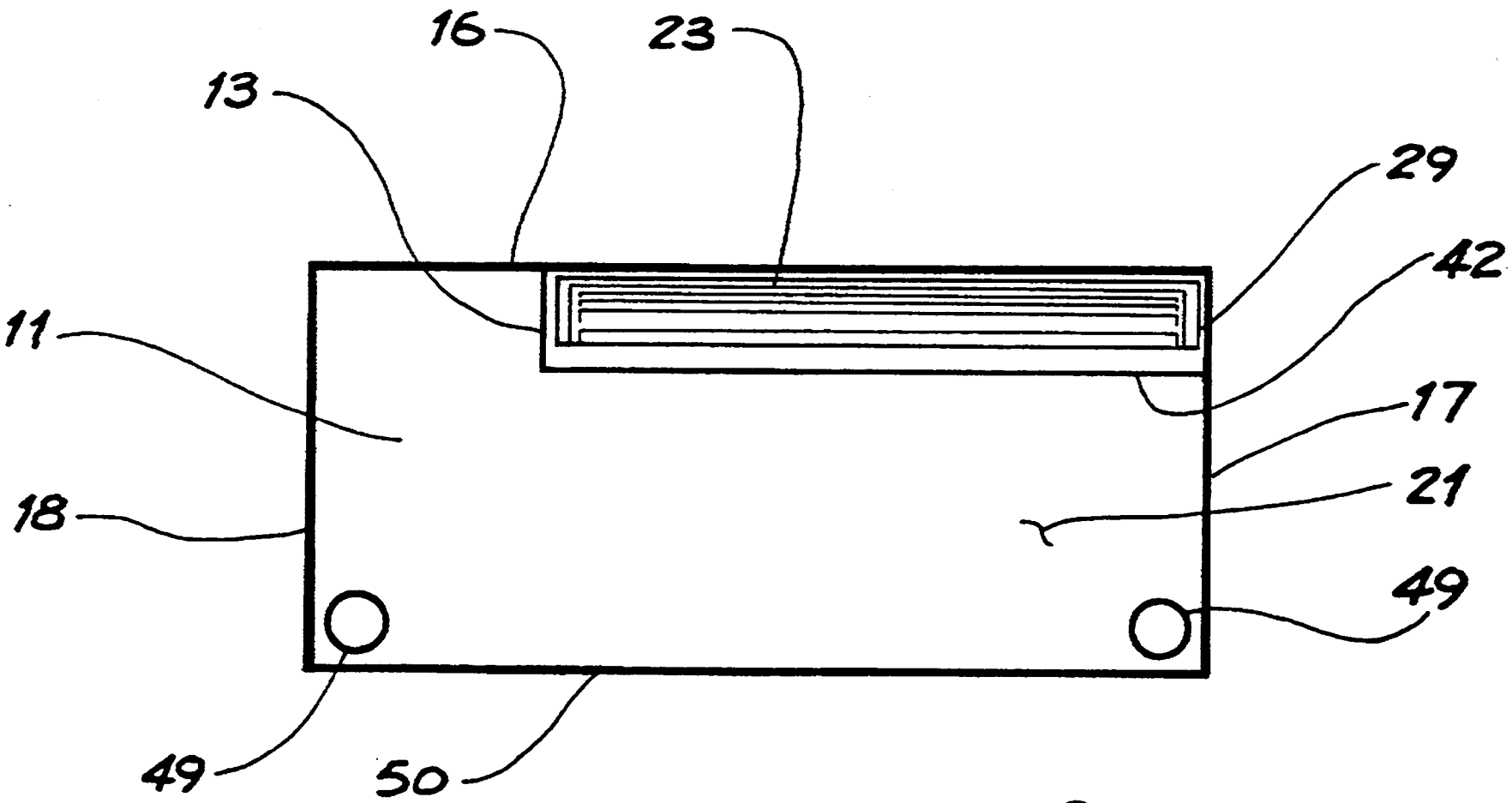
FIG. 8 is an outdoor view of only the fan of FIG. 1.

As the motor rotates, the blower spins accordingly about its axis. FIG. 5 depicts the fan in the intake mode with the blower spinning counter-clockwise when viewed from the motor. The blower includes a series of radial fins (32) which extend fully the horizontal length of the blower. As these fins are rotated, air (33) is pushed counter-clockwise and tangentially from the blower. A component of the blower assembly immediately surrounding the cylindrical blower is the partially cylindrical blower housing (34) which confines that air except above the bottom edge of the first and second openings. First (35) and second (36) upper horizontal surfaces of the blower housing integrally extend from the blower housing to the bottom edge of the first and second openings, respectively, to form first (37) and second (38) internal ducts. As the blower fins push air tangentially from the blower, the air can only escape from the housing through the first opening and must enter the housing through the second opening, thereby providing the intake function. Air drawn into the second opening enters via the external duct and therefor through the window opening (39).

The fan depends from the window (40) by hanging from the window stool (41). A vertical wall (42) projects downwardly from the bottom (43) of the external duct outdoorwardly adjacent the vertical outdoor surface (44) of the stool cap (45). This wall retains the fan from movement towards the indoors (46) unless such movement includes upward or rotational movement over the stool cap. The horizontal indoor-to-outdoor distance from the outdoor surface of the fan housing and the vertical outdoor surface of the stool cap is approximately three and one half inches and therefor allows for hanging of the fan over tool caps of the same maximum size. With windows within standard specifications, this can result in an indoor-to-outdoor distance between the outdoor surface of the fan housing and the indoor surface (47) of the building (48) of up to two and one half inches. To support the fan from the indoor surface of the building, accounting also for the range of possible distances therebetween two feet (49) extend from the outdoor surface of the fan housing adjacent the bottom surface (50) and first and second end surfaces of the fan housing. These feet are adjustable indoor-to-outdoor by screwthread engagement (51) with the fan housing.

Being positioned approximately eight inches below and only about one inch indoor of the vertical outdoor surface of the stool cap, the contact point (52) between the feet and the indoor surface of the building lies almost directly below the contact point (53) between the wall extending downwardly from the external duct and the vertical outdoor surface of the stool cap. Since the approximate center of gravity (54) of the fan lies approximately four inches indoor of the indoor surface of the building and vertically between the two contact points, a stable condition exists pulling the fan downwardly and indoorwardly against the stool cap and pushing it outdoorwardly against the building. The window sash (55) can be raised as desired without affecting the engagement of the fan to the window.

Obviously, many modifications and variations of the present invention are possible in light of the above teachings. It is to be understood, therefore, that the invention can be practiced otherwise than as specifically described.

What I claim is:

1. An electrical fan for positioning at a window opening and hanging from the stool thereof, said fan having a center of gravity and comprising a housing and a motor driven cylindrical air blower having a major diameter, and a horizontally oriented rotational axis parallel to a plane containing said window opening, said housing enclosing said air blower and having intake and exhaust openings for allowing the passage of air blown by said blower therethrough perpendicular to said rotational axis, said housing further having a rectangular duct extending therefrom with an internal minor duct width smaller than said major diameter of said blower, said duct communicating with said intake and exhaust openings and with said window opening such that said blown air flows through said duct and through said window opening, wherein said duct comprises a downwardly projecting wall depending therefrom and lying on said plane containing said window opening, said downwardly projecting wall adapted to engage said stool and retain said fan from indoorward movement thereat, said housing further having one or more support feet adapted to contact an indoor building surface below said window opening and retain said fan from outdoorward movement thereat, and wherein said center of gravity is disposed indoorwardly of and vertical between said downwardly projecting wall and said indoor building surface, whereby said fan is adapted to engage said window stool and indoor building surface such that said air blower is positioned indoor of said window opening.

2. A fan as in claim 1 wherein said one or more support feet are horizontally adjustable.

3. A fan as in claim 1 wherein said blower rotation direction is reversible and said air flow direction is reversible thereby.

* * * * *